US009206558B2

(12) United States Patent
Vargas et al.

(10) Patent No.: US 9,206,558 B2
(45) Date of Patent: Dec. 8, 2015

(54) RECIPROCATION SYSTEM AND METHOD FOR RAIL VEHICLE

(71) Applicant: HARSCO CORPORATION, Camp Hill, PA (US)

(72) Inventors: Victor Vargas, Lexington, SC (US); Eric M. Carter, Cayce, SC (US); Lee Bolton, Seneca, SC (US); Daniel B. Guptail, Lexington, SC (US)

(73) Assignee: HARSCO CORPORATION, Camp Hill, PA (US)

( * ) Notice: Subject to any disclaimer, the term of this patent is extended or adjusted under 35 U.S.C. 154(b) by 259 days.

(21) Appl. No.: 13/909,878

(22) Filed: Jun. 4, 2013

(65) Prior Publication Data

US 2014/0352569 A1 Dec. 4, 2014

(51) Int. Cl.
*E01B 27/16* (2006.01)

(52) U.S. Cl.
CPC ..... *E01B 27/16* (2013.01)

(58) Field of Classification Search
CPC ..... E01B 27/17; E01B 27/16; E01B 2203/10; E01B 2203/12; E01B 2203/127
USPC ..... 104/12, 246, 95, 118, 2; 105/155, 141, 105/163.1, 153
See application file for complete search history.

(56) References Cited

U.S. PATENT DOCUMENTS

| | | | | | |
|---|---|---|---|---|---|
| 987,253 | A | * | 3/1911 | Neale | 104/115 |
| 3,540,380 | A | * | 11/1970 | Tumpak et al. | 104/246 |
| 3,687,081 | A | * | 8/1972 | Plasser et al. | 104/12 |
| 4,094,250 | A | * | 6/1978 | Theurer | 104/12 |
| 4,635,557 | A | * | 1/1987 | Mohr et al. | 104/12 |
| 4,913,058 | A | | 4/1990 | Mancini | |
| RE33,696 | E | * | 9/1991 | Stevenson | 267/33 |
| 5,615,616 | A | * | 4/1997 | Scheuchzer et al. | 104/2 |
| 2007/0199471 | A1 | | 8/2007 | Theurer et al. | |
| 2012/0004795 | A1 | | 1/2012 | Miller et al. | |

OTHER PUBLICATIONS

International Search Report and Written Opinion, PCT/US2014/038114, dated Oct. 27, 2014, 15 pages.

* cited by examiner

*Primary Examiner* — Mark Le
(74) *Attorney, Agent, or Firm* — Baker & McKenzie LLP

(57) ABSTRACT

A rail vehicle includes a reciprocation system comprised of independently movable work heads for carrying out rail maintenance operations.

13 Claims, 7 Drawing Sheets

RECIPROCATION SYSTEM AND METHOD FOR RAIL VEHICLE

TECHNICAL FIELD

The present disclosure generally relates to the field of rail vehicles, and more particularly, to a reciprocation system for translating work heads associated with rail vehicles.

BACKGROUND

Railroads are generally constructed of a pair of elongated, substantially parallel rails, which are coupled to a plurality of laterally extending ties via metal tie plates and spikes and/or spring clip fasteners. The rails and ties are disposed on a ballast bed formed of hard particulate material, such as gravel.

During installation of new railroad and maintenance of existing railroad, the ballast adjacent to and/or under the ties is "tamped," or compressed, to ensure that the ties, and therefore the rails, do not shift. A rail vehicle for carrying out tamping operations is generally referred to as a "tamper" and includes work heads for carrying out tamping operations. Such work heads typically include a number of tamper tools, which each include a pair of elongated, vertically extending tamper arms that terminate in a prong or multiple prongs. The tamper arms and associated prongs are adapted to move towards one another in a pincer-like motion in order to compress the ballast adjacent to and underlying the ties. Vibration of the tamper arms and associated prongs further compresses the ballast. In practice, multiple vibration devices may be employed in order to provide tools for tamping inside and outside the rails as well as forward and aft of the ties. Such tamping operations may be carried out at each tie via a tamper vehicle, which advances along the rails.

Tamper vehicles may stop at each tie to perform tamping operations, or alternatively, tamper vehicles may take the form of a "continuous action" tamper vehicle, which does not stop at each tie, but which rather progresses slowly along the rails in a continuous fashion. Such continuous action tamper vehicles have heretofore employed work heads that operate in unison to perform tamping operations at each tie. That is, the work heads repeatedly translate, or "reciprocate," along a frame of the rail vehicle during tamping operations. For example, the rail vehicle continues to move along the rails while the tamper tools perform tamping operations. Upon completion of tamping operations at a particular tie, the work heads move forward in unison to the next tie. This process is repeatedly carried out.

However, such continuous action tamper vehicles have drawbacks. During tamping operations, it is quite typical to come upon a misaligned, skewed, or enlarged tie. Because the work heads are required to move in unison, it is likely that at least one of the tamping tools will be deployed into the tie, thus potentially damaging both the tie and the tamping tool. In such circumstances, the tool may need to be replaced, which results in loss of efficiency. Accordingly, systems and methods for overcoming such problems are desired.

BRIEF SUMMARY

The present disclosure generally relates to a continuous action rail vehicle, such as a continuous action tamper vehicle. The continuous action tamper vehicle includes a plurality of work heads depending downwardly from a corresponding plurality of carriage members disposed along a frame of the tamper vehicle. Each of the work heads includes one or more tools for maintaining track. For example, each work head may include one or more tamping tools, which are operable to be disposed into ballast and actuated to "tamp" or compress ballast adjacent to and underlying railroad ties. The carriage members are adapted to independently translate along the frame so as to repeatedly carry out tamping operations while the tamper vehicle is in motion. In some embodiments, each carriage member is connected to an associated hydraulic cylinder for effecting independent movement of each carriage member. By providing for independent movement of the carriage members, and therefore the work heads and associated tamping tools, the rail vehicle of the present disclosure can account for misaligned or skewed ties by independently moving the work head into an appropriate position so as to not effect contact between the tamping tool and the misaligned or skewed tie. Related methods for operating the continuous action tamper vehicle are also described.

BRIEF DESCRIPTION OF THE DRAWINGS

Reference is now made to the following descriptions taken in conjunction with the accompanying drawings.

DETAILED DESCRIPTION

Various embodiments of a rail vehicle employing independently movable work heads and associated methods of using such rail vehicles according to the present disclosure are described. It is to be understood, however, that the following explanation is merely exemplary in describing the devices and methods of the present disclosure. Accordingly, several modifications, changes and substitutions are contemplated.

Rail maintenance processes for addressing wear and tear on a railroad typically involve the use of a tamping machine with associated clamp assembly, which cooperate to carry out geometric corrections of the track. A typical correction process involves lifting rail panel with mechanical clamps, aligning the track by shifting it to a calculated position, and then tamping the ballast under each tie to hold the track in place. This work sequence is typically repeated at each tie during the course of the correction process.

Figure 1:
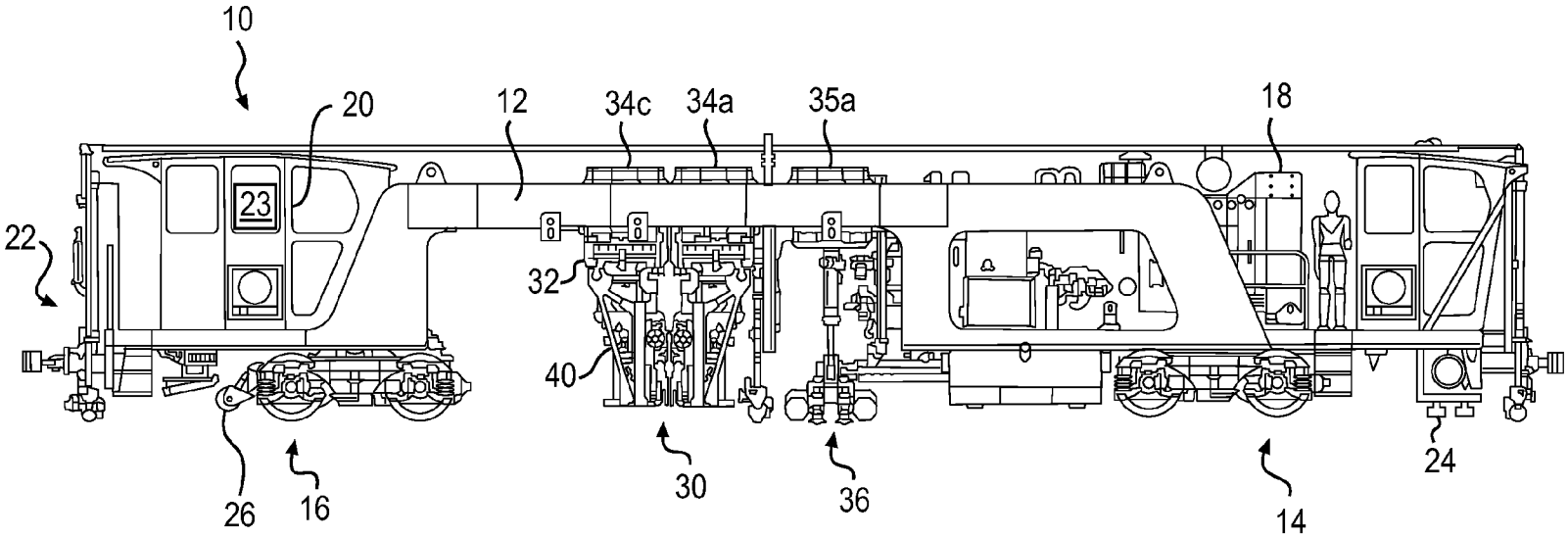
FIG. 1 illustrates a side view of an exemplary continuous action tamper vehicle according to the present disclosure.

A rail vehicle 10 is illustrated in FIG. 1 for use in such rail construction and/or maintenance operations. In one embodiment, the rail vehicle 10 is a continuous action tamper vehicle for use in performing tamping operations on a railroad. The term "continuous action" may refer to tamper vehicles that are in constant motion during operations, or may also refer to tamper vehicles that are substantially in constant motion, yet experience brief, intermittent stops during operations. The continuous action tamper vehicle 10 includes a frame 12 and a forward set of rail wheels 14 and an aft set of rail wheels 16 coupled to the frame and adapted to engage and travel along rails of a railroad track. A propulsion device 18 is disposed on the frame and is adapted to propel the continuous action tamper vehicle along the rails. The frame 12 further includes an operator cabin 20 at a rear end 22 of the vehicle. The operator cabin 20 provides operator access to a control system 23 associated with the rail vehicle as will be described further herein. The continuous action tamper vehicle 10 further includes a tie locator 24 and an associated encoder wheel 26, which will be further described with respect to the operation of the continuous action tamper vehicle.

Figure 2:
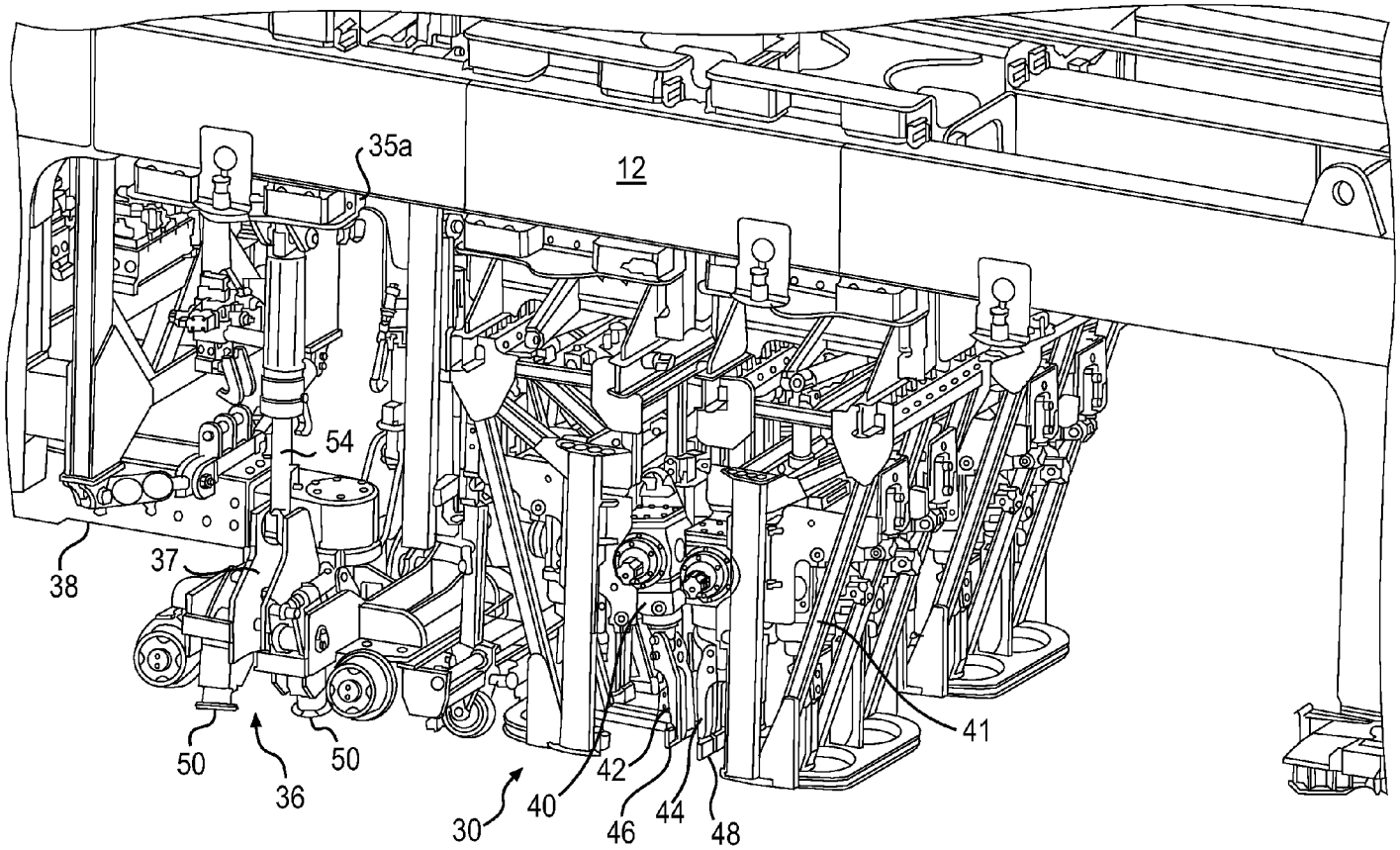
FIG. 2 illustrates a perspective view of a set of work head assemblies and clamp assembly operatively connected to the continuous action tamper vehicle of FIG. 1.

Referring to FIGS. 1-2, the continuous action tamper vehicle 10 further includes a set of work head assemblies 30 operatively coupled to the frame 12 via mounting units 32 and carriage members 34*a-d*. A clamp assembly 36 is provided adjacent to the work head assemblies 30 and is coupled to the frame 12 via a clamp assembly frame 37 and another set of carriage members 35*a-b*. The clamp assembly frame 37 is further coupled to a lining arm 38, which is operatively coupled to the rail frame 12.

The work head assemblies 30 include work heads 40 operatively coupled to associated work head frames 41, which engage corresponding mounting units 32. For example, in one embodiment, the work head frames 41 are bolted to the mounting units 32, which are bolted to the carriage members 34. In this manner, the mounting units 32 (and therefore the carriage members 34) carry the work head assemblies 30 thereon as will be described. Each set of work heads 40 includes a vibration device and a pair of elongated, vertically extending tools 42, 44. The elongated tools 42, 44 terminate at prongs 46, 48, which are adapted to engage into ballast disposed around a railroad track. In some embodiments, only one prong is provided per tool. The prongs 46, 48 generally comprise flat plates that extend generally laterally to the rails. The elongated, vertically extending tools 42, 44 are spaced apart to engage and tamp the ballast on either side of a worksite tie (not shown) without contacting an adjacent tie.

The clamp assembly 36 includes a pair of roller clamps 50 disposed adjacent to each rail. The roller clamps 50 extend from a clamp assembly frame 52, which is operatively connected to the carriage member 35*a* via a hydraulic cylinder 54. The roller clamps 50 may be actuated to engage both sides of the adjacent rail. That is, the roller clamps 50 may be rotated into position to engage and thereby "grip" the rail. After engagement, the hydraulic cylinder 54 may be actuated to lift the rail (and thus the ties connected therebetween) to perform geometric corrections to rail orientation. After appropriate geometric corrections are carried out, the hydraulic cylinder 54 may again be actuated to place the rail back into contact with the underlying ballast. As the continuous action tamper vehicle continues its progress along the rails, the tamper assemblies are subsequently positioned adjacent to the ties just lifted. The tamper assemblies 30 may then perform tamping operations to thereby further couple the rail and associated ties to the underlying ballast.

To achieve efficiency of operation, a continuous action tamper vehicle, continuously, or substantially continuously, carries out the lifting and tamping operations while the vehicle travels along the rails. The work head assemblies 30 and clamp assembly 36 may accommodate such continuous action by allowing for translation of the work head assemblies and clamp assembly relative to the frame 12 during operation, while also allowing for translation of the frame relative to the work head assemblies and the clamp assembly. Such an arrangement achieves the desired reciprocation. Furthermore, to account for misaligned ties and/or ties of varying width, the work head assemblies 30 may be independently translated relative to one another.

Figure 3:
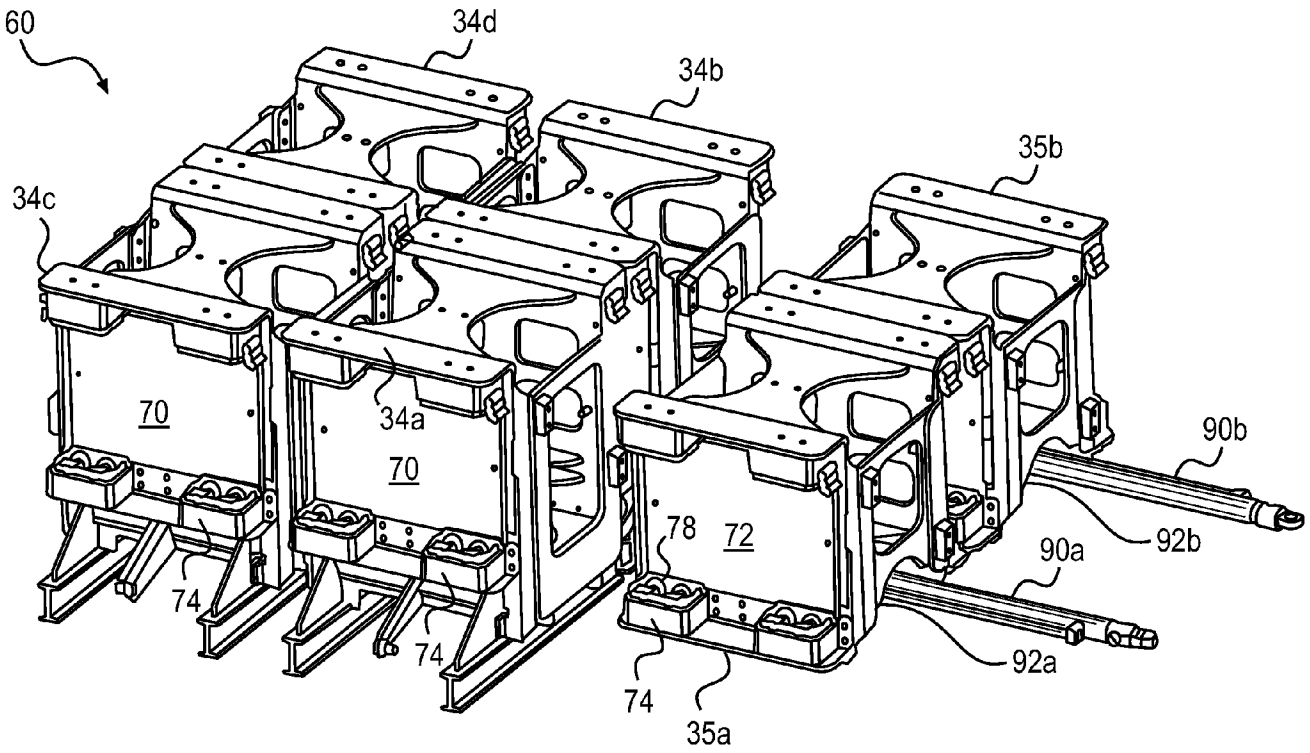
FIG. 3 illustrates a top perspective view of a reciprocation system associated with the continuous action tamper vehicle of FIG. 1.
Figure 4:
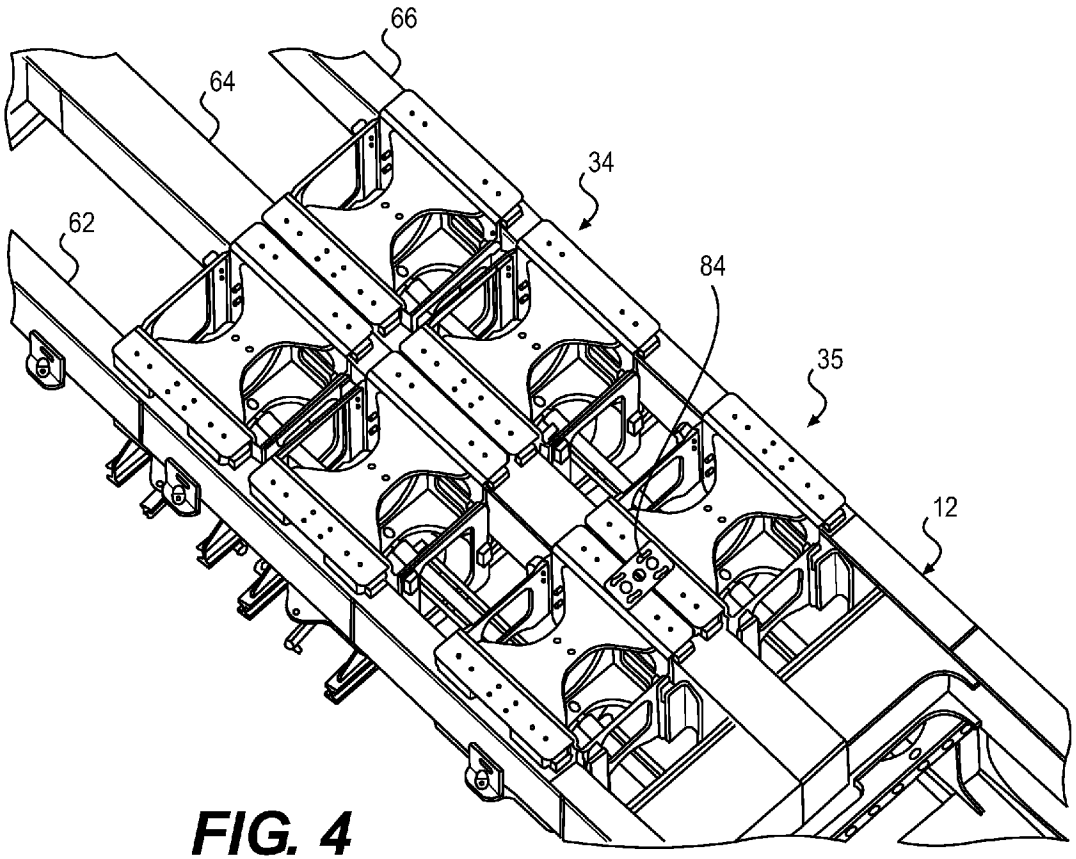
FIG. 4 illustrates a top perspective of the reciprocation system of FIG. 3 in which the reciprocation system is operatively connected to a frame of the continuous action tamper vehicle of FIG. 1.
Figure 5:
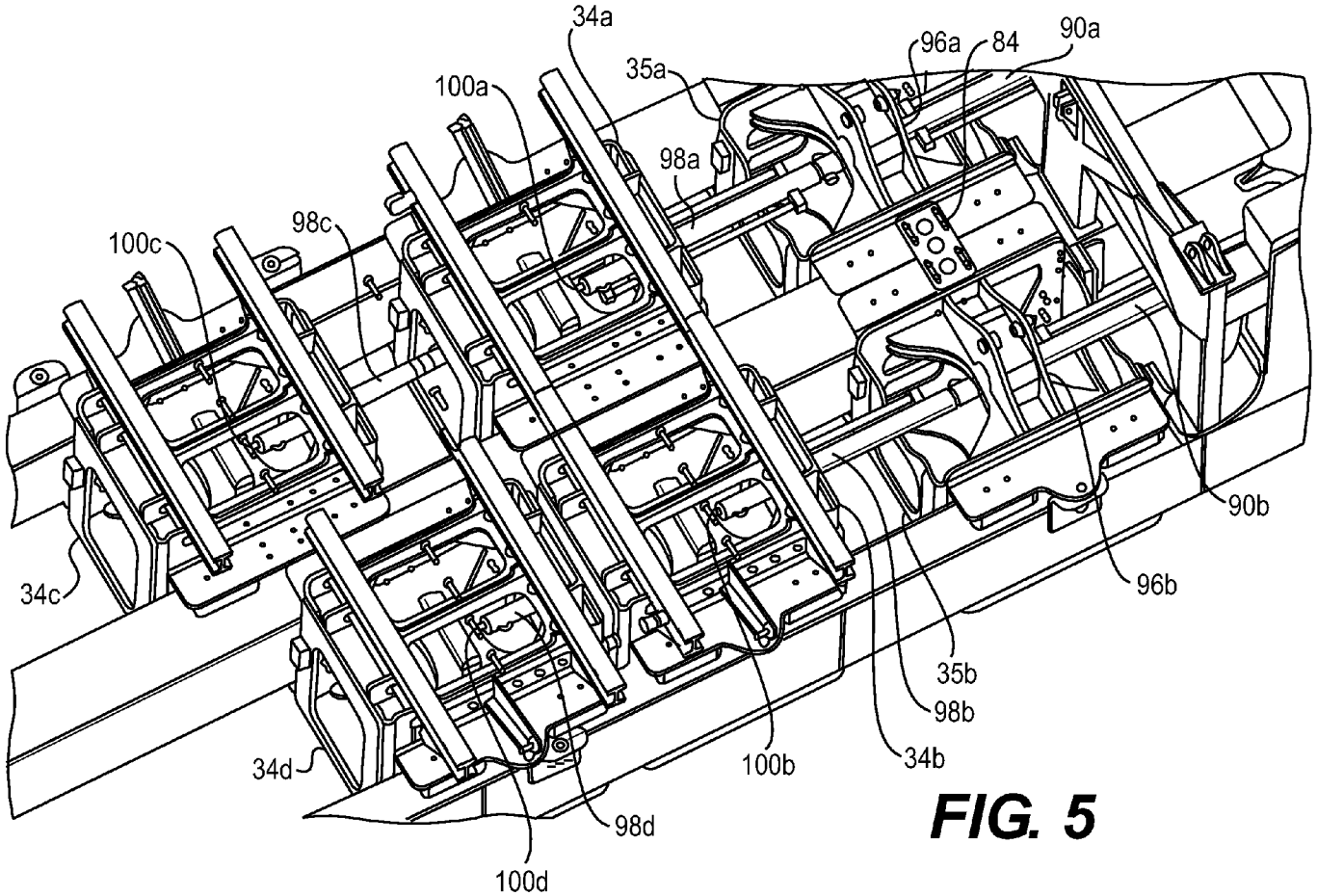
FIG. 5 illustrates a bottom perspective view of the reciprocation system of FIG. 4.

Referring to FIGS. 3-5, a reciprocation system 60 allowing for independent translation of the work head assemblies 30 and translation of the clamp assembly 36 is shown to include the aforementioned carriage members 34, 35, respectively, which are adapted to translate along the frame 12. The portion of the frame 12 adjacent the carriage members 34, 35 preferably includes three longitudinally-extending rails 62, 64, 66, which are arranged to receive the carriage members thereon. In one embodiment, the carriage members 34, 35 include laterally-outward facing sidewalls for guiding the rails 62, 64, 66. Each of the carriage members 34, 35 includes a plurality of roller assemblies 74, which facilitate sliding of the carriage members 34, 35 along the rails 62, 64, 66.

Figure 6:
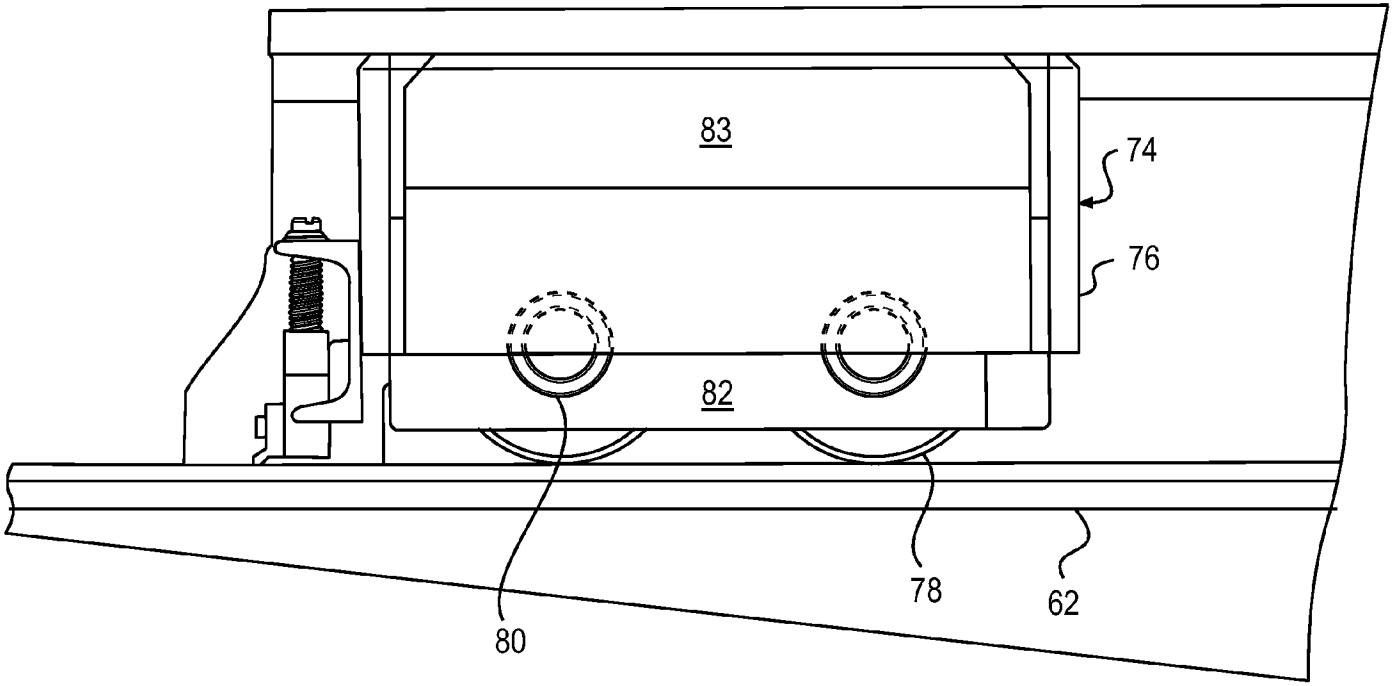
FIG. 6 is a side view of a roller box assembly associated with the reciprocation system of FIG. 3.

Referring to FIG. 6, one such roller assembly 74 is shown disposed within a casing 76 integrally formed with the carriage members 34, 35. Of course, in other embodiments, the casing 76 may be modular and thus removably connected to the carriage members 34, 35. The roller assembly 74 preferably includes a pair of roller elements 78 situated on axles 80, which are rotatably secured to a roller frame 82 disposed within or substantially within the casing 76. The roller assembly 74 is biased toward the corresponding rail (rail 62 in FIG. 6) via a spring 83, which is disposed between the roller assembly and an upper end of the casing 76. In one embodiment, the spring 83 preferably takes the form of a rubber spring. However, other embodiments are contemplated in which coil springs and/or other types of biasing members are used to urge the roller assembly 74 (and thus the roller elements 78) against the corresponding longitudinally-extending rail of the frame 12. The reciprocation system 60 may include one pair of roller assemblies 74 per laterally-outward facing sidewall 70, 72, or alternatively may include more than one pair of roller assemblies per laterally-outward facing sidewall 70, 72.

Referring again to FIGS. 3-5, the carriage members 35 operatively coupled to the clamp assembly 36 are preferably adapted to translate in unison as it is desirable to perform track leveling operations when lifting each rail at substantially the same longitudinal position along the track. As such, to ensure movement in unison, a clamp 84 (FIG. 4) may be utilized to connect the carriage members 35. However, in other embodiments, the clamp may be removed and the reciprocation system 60 may rely on computer-controlled movement of the carriage members 35 to ensure the carriage members 35 move in unison with the lining arm 38 as will be described. In embodiments utilizing the clamp 84, the clamp may be secured to the carriage members 35 via a conventional mechanical connection, such as a bolted connection, to thereby fix the carriage members in position relative to one another. The clamp 84 may be used on a top side of the carriage members 35 (FIG. 4) and/or on a bottom side of the carriage members 35 (FIG. 5).

The carriage members 35 are operatively coupled to the frame 12 via a pair of actuation members, such as hydraulic cylinders 90*a-b*, which may connect to the frame via any known connection mechanism, such as a bolted connection (FIG. 5). The carriage members 35 preferably include a cutout portion 92*a-b* to accommodate passage of the hydraulic cylinders 90 therethrough. The hydraulic cylinders 90 terminate at an interior portion of the carriage members 35 and are operatively coupled to a lower frame member 96*a-b* of the carriage members 35. In practice, the hydraulic cylinders 90 may be actuated to translate the carriage members 35 along the rails 62, 64, 66, and therefore cause translation of the clamp assembly 36 relative to the frame 12 as will be further described.

The carriage members 34 for carrying the work head assemblies 30 are similar in construct to the carriage members 35, yet are adapted to move independently of one another along the rails 62, 64, 66. As such, each carriage member 34 is operatively connected to an actuation member, such as hydraulic cylinders 98*a-d*, which in some embodiments, may be substantially similar to the hydraulic cylinders 90*a-b*. In some embodiments, the hydraulic cylinders 98*a-d* are connected between carriage members. More specifically, the forward set of hydraulic cylinders 98*a-b* may be operatively connected between carriage members 34*a*, 34*b* and carriage members 35*a*, 35*b*, respectively. The hydraulic cylinders 98*a-b* may be coupled to such respective carriage members via a mechanical connection, such as a bolted connection. Accordingly, the hydraulic cylinders 98*a-b* may be coupled to the lower frame member 96*a-b* of the carriage members 35 as well as a lower frame member 100*a-b* of the carriage members 34*a-b*. Similarly, the aft set of hydraulic cylinders 98*c*, 98*d* may be operatively connected between carriage members 34*a*, 34*b* and carriage members 34*c*, 34*d*, respectively. The hydraulic cylinders 98*c-d* may be coupled to such respective carriage members via a mechanical connection, such as a bolted connection. Accordingly, the hydraulic cylinders 98*c-d* may be coupled to the lower frame member 100*a-b* of the carriage members 35*a*, 35*b* as well as a lower frame member 100*c-d* of the carriage members 35*c-d*.

In practice, the hydraulic cylinders 98*a-d* may be independently actuated to thereby achieve independent movement of each carriage member 34*a-d* along the rails 62, 64, 66 of the frame. Accordingly, to facilitate such independent movement, each of the hydraulic cylinders 98*a-d* includes a receiver for receiving instructions from the control system 23. Although shown in FIG. 1 as being located on the rail vehicle 10, it is to be understood that, in some embodiments, the control system 23 may be located remotely of the rail vehicle 10. The control system 23 is configured to receive input from the tie locator 24 and/or encoder wheel 26 regarding positioning of ties to be worked. If the tie locator 24 identifies a misaligned tie, or other deviation from standard rail configuration, the control system 23 will instruct the reciprocation system 60 to accommodate such deviation. More specifically, the control system 23 may send instructions to one or more of the hydraulic cylinders 98*a-d* to accommodate the deviation. For example, if a tie is determined to be misaligned, the control system 23 may instruct the hydraulic cylinder 98*a* to translate only a small distance (relative to a larger distance consistent with normal tie locations), thereby translating the carriage member 98*a* and the corresponding tamper tool the same small distance. In this manner, each tamper tool may be independently actuated into position to avoid the tool coming into contact with the misaligned tie when the tool is deployed to tamp ballast.

Figure 7:
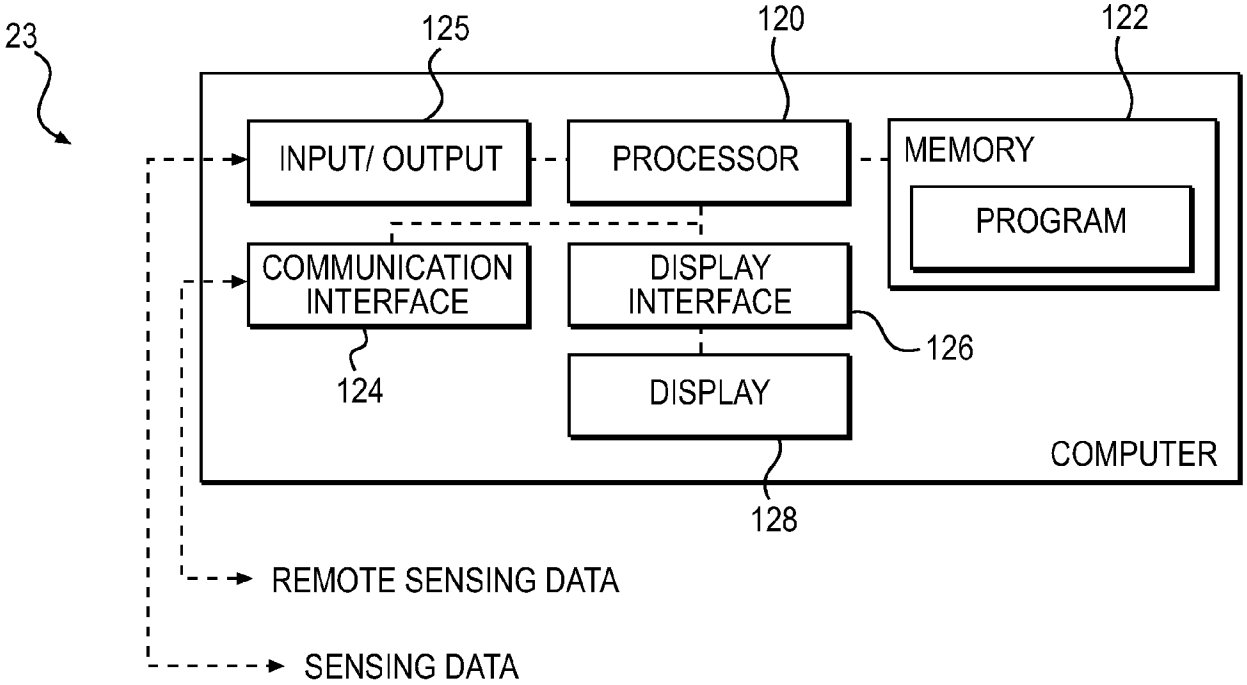
FIG. 7 is a schematic depiction of a control system for controlling the reciprocation system of FIGS. 3-5.

Referring to FIG. 7, the control system 23 may take the form of a computer or data processing system that includes a processor 120 configured to execute at least one program stored in memory 122 for the purposes of performing one or more of the processes disclosed herein. The processor 120 may be coupled to a communication interface 124 to receive remote sensing data as well as transmit instructions to receivers distributed throughout the rail vehicle 10, including the receivers associated with the hydraulic cylinders 98*a-d*. The processor 120 may also receive and transmit data via an input/output block 125. In addition to storing instructions for the program, the memory may store preliminary, intermediate and final datasets involved in techniques that are described herein. Among its other features, the control system 23 may include a display interface 126 and a display 128 that displays the various data that is generated as described herein. It will be appreciated that the control system 23 shown in FIG. 7 is merely exemplary in nature and is not limiting of the systems and methods described herein.

While various embodiments of a reciprocation system for rail vehicle and related methods of using such systems have been described above, it should be understood that they have been presented by way of example only, and not limitation. Thus, the breadth and scope of the present disclosure should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

What is claimed is:

1. A rail vehicle, comprising:

a frame comprising at least two rails extending in a longitudinal direction;

a reciprocation system operatively connected to the frame; and a plurality of work head assemblies coupled to the reciprocation system;

wherein the reciprocation system comprises:

a plurality of carriage members extending between and coupled to two of the at least two rails and the carriage members further defining interior portions having lower frame members disposed in the interior portions; and a plurality of actuation members for coupling longitudinally adjacent carriage members to independently translate the carriage members along the frame, wherein the actuation members are coupled to the lower frame members defined within the interior portions of the carriage members.

2. A rail vehicle according to claim 1, wherein the work head assemblies comprise a tamper tool at a distal end thereof.

3. A rail vehicle according to claim 1, wherein the plurality of carriage members comprise a first set of carriage members, the reciprocation system further comprising a second set of carriage members operatively connected to one another to thereby provide for synchronous movement of the second set of carriage members.

4. A rail vehicle according to claim 3, further comprising a clamp assembly coupled to the second set of carriage members.

5. A rail vehicle according to claim 1, wherein at least one of the actuation members is a hydraulic cylinder.

6. A rail vehicle according to claim 1, further comprising a plurality of roller assemblies coupled to each carriage member, the roller assemblies comprising at least one roller for engaging the frame.

7. A rail vehicle according to claim 6, wherein the roller assemblies engage opposing sides of the frame.

8. A rail vehicle according to claim 6, wherein at least one of the roller assemblies comprises a roller frame for carrying the at least one roller, and further wherein the at least one roller assembly comprises a spring biased against the roller frame.

9. A rail vehicle according to claim 8, wherein the spring is a rubber spring.

10. A rail vehicle according to claim 1, wherein the plurality of carriage members comprises a first set of carriage members, the reciprocation system further comprising a second set of carriage members operatively connected to one another to thereby provide for synchronous movement of the second set of carriage members, and further comprising an additional plurality of actuation members for coupling the second set of carriage members to the frame, wherein the additional plurality of actuation members are coupled between the lower frame members defined within the interior portions of the carriage members and the frame.

11. A method for reciprocating work heads coupled to a rail vehicle, comprising:

providing a plurality of carriage members extending between and being coupled to a pair of rails of a frame of the rail vehicle, the work heads depending downwardly from the carriage members, wherein the carriage members define interior portions having lower frame members disposed in the interior portions; and using actuation members coupled between the lower frame members defined within the interior portions of the carriage members to independently translate the carriage members along the frame to thereby provide for independent movement of the work heads relative to one another.

12. A method according to claim 11, wherein a first actuation member imparts movement to a first carriage member to thereby translate first carriage member a distance X, and further wherein a second actuation member imparts movement to a second carriage member to thereby translate second carriage member a distance Y, wherein Y is greater than X.

13. A method according to claim 11, further comprising one or more roller assemblies disposed between each of the carriage members and the frame, the roller assemblies being coupled to the corresponding carriage members, wherein actuating the actuation members to thereby impart movement to the carriage members causes the roller assemblies to roll along the frame.

* * * * *